United States Patent [19]

Gordon

[11] Patent Number: 4,667,803

[45] Date of Patent: May 26, 1987

[54] SINGLE PAPER DISPENSER

[76] Inventor: Roger G. Gordon, 5363 Heavenly Ridge La., Richmond, Calif. 94803

[21] Appl. No.: 789,343

[22] Filed: Oct. 16, 1985

Related U.S. Application Data

[63] Continuation of Ser. No. 598,646, Apr. 10, 1984, abandoned.

[51] Int. Cl.[4] ..... G07F 11/58

[52] U.S. Cl. ..... 194/248; 221/195; 221/227; 221/231; 221/241

[58] Field of Search ..... 221/155, 195, 227, 230, 221/231, 232, 240, 241, 266, 254, 277; 194/233, 248, 345

[56] References Cited

U.S. PATENT DOCUMENTS

| | | | |
|---|---|---|---|
| 1,263,033 | 4/1918 | Campbell | 221/240 X |
| 2,396,411 | 3/1946 | Cameron | 221/231 X |
| 2,926,814 | 3/1960 | Utiger | 221/231 X |
| 3,062,407 | 11/1962 | Cordis | 221/230 X |
| 3,168,212 | 2/1965 | Edwards | 221/231 X |
| 3,263,859 | 8/1966 | Searle | 221/227 |
| 4,063,629 | 12/1977 | Gordon | 194/1 K |

*Primary Examiner*—F. J. Bartuska

*Attorney, Agent, or Firm*—Townsend and Townsend

[57] ABSTRACT

A single paper dispenser is disclosed. The dispenser includes a frame which has a support plate for supporting the papers in a generally horizontal stack. The support plate has a forward, slotted edge, and the stack of papers are biased toward that edge. Cams are provided which are rotatable about an axis parallel to the slotted edge. The cams each have tongues which are movable upwardly through these slots and then forwardly relative to the support plate as they are rotated. The rotated cam elements engage the forwardmost paper in the stack with the tongues projecting through the slots, lift and separate the forwardmost paper from the remainder of the stack, and drop the separated paper past the forward edge of the support plate.

21 Claims, 22 Drawing Figures

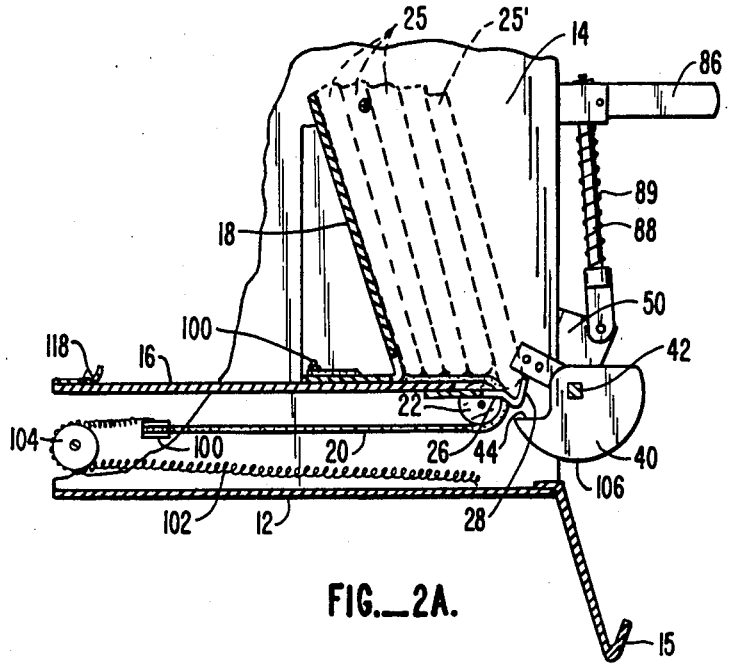
FIG._2A.
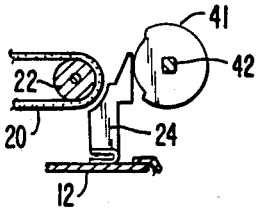
FIG._3A.
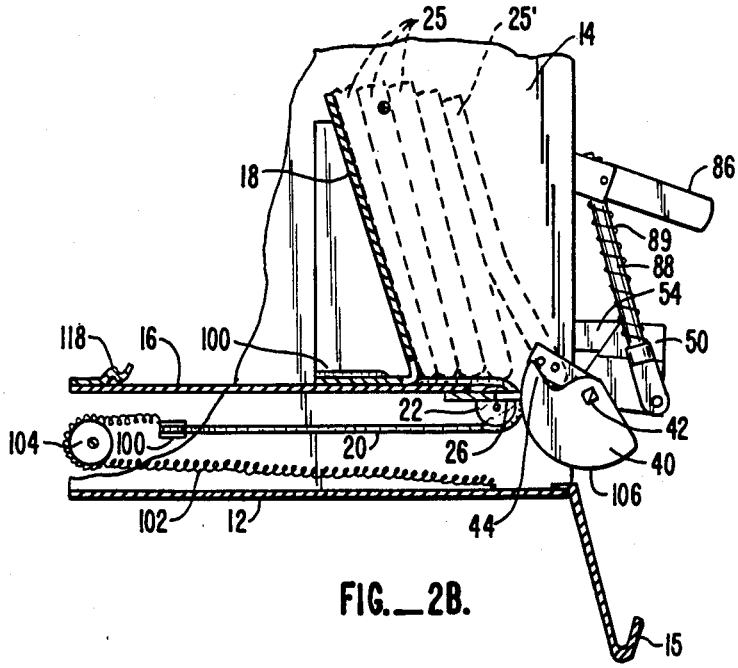
FIG._2B.
FIG._3B.

SINGLE PAPER DISPENSER

This is a continuation of application Ser. No. 598,646, filed Apr. 10, 1984, now abandoned.

BACKGROUND OF THE INVENTION

The present invention relates to a dispenser of single newspapers, and in particular to a coin-operated newspaper dispenser in which the papers are individually dispensed upon insertion of the proper coinage.

The typical street corner newspaper rack has a metal box which holds a vertical stack of newspapers, and a front vertical or near-vertical door which can be opened when the proper coinage is inserted. Once the front door is open, the user has access to the entire stack of newspapers, but it is presumed that the user has use for only one newspaper and will leave the rest for the next customer. Unfortunately, this system is defenseless against the unscrupulous user who might insert the necessary coinage to obtain a single paper, but remove the entire stack and sell the papers on his own at considerable profit. Also, where patronage is heavy, the temptation to leave the door open for the next purchaser is at times overwhelming.

The desirability of a dispenser which would issue only one paper at a time when the appropriate coinage is inserted is manifest. However, the design of such a single paper dispenser which will withstand abuse and resist tampering in a street corner environment, and adapt to the varying thicknesses of different newspapers, has proved to be difficult. Attempts at designing such dispensers are illustrated in U.S. Pat. Nos. 1,621,960; 3,957,175; and 4,085,864, but these dispensers are not used extensively. At present, the conventional fully openable rack is used almost exclusively despite its deficiencies because single dispenser designs have proved to be unequal to the task.

SUMMARY OF THE INVENTION

The present invention provides a single paper dispenser. The dispenser includes a frame which has a support plate for supporting the papers in a generally horizontal stack, with the folded edges down. The support plate has a forward, slotted edge, and the stack of papers are biased toward that edge. Cams are provided which are rotatable about an axis parallel to the slotted edge. The cams each have tongues which are movable upwardly through these slots and then forwardly relative to the support plate as they rotate. The rotated cam elements engage the forwardmost paper in the stack with the tongues projecting through the slots, lift and separate the forwardmost paper from the remainder of the stack, and drop the separated paper past the forward edge of the support plate.

The dispenser of the present invention is designed primarily for coin operation. The preferred embodiment includes a coin holder, and a coin bar underlying the coin holder and attached to the rotatable cams. A ramp is fixed to the coin bar and engages the coins when deposited, and the coins deflect the coin bar away from a stop so that the cams can be rotated with the coins in position. The cam elements preferably have a rounded portion following the tongues to hold the remaining papers in position as the forwardmost paper is dispensed. The forward, slotted edge of the frame bottom contains an adjustable lip so that different size papers can easily be accommodated. A backplate supports the papers in a generally vertical configuration, and spring-biased belts extend forwardly from the backplate along the bottom of the frame under the papers to bias the papers forwardly. A brake is provided to hold the belts in position while a paper is being dispensed.

The present invention provides a reliable dispenser of single papers which is also relatively impervious to damage and tampering, and thus usable in a street-corner environment. The system is designed as a module which can be used as original equipment or in a retrofit mode in many existing racks.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIGS. 2A–2C are a sequence of fragmentary sectional views along lines 2—2 of FIG. 1 illustrating the dispensing of a single newspaper by the embodiment of FIG. 1;

FIGS. 3A–3C are a sequence of fragmentary sectional views taken along lines 3—3 of FIG. 4 illustrating the belt brake;

FIGS. 8A–9D is a sequence of fragmentary perspective views illustrating the operation of the coin mechanism of the embodiment of FIG. 1;

FIGS. 9A–9D are a sequence of fragmentary elevation views of the coin bar operation corresponding to FIGS. 8A–D;

DESCRIPTION OF THE PREFERRED EMBODIMENT

Figure 1:
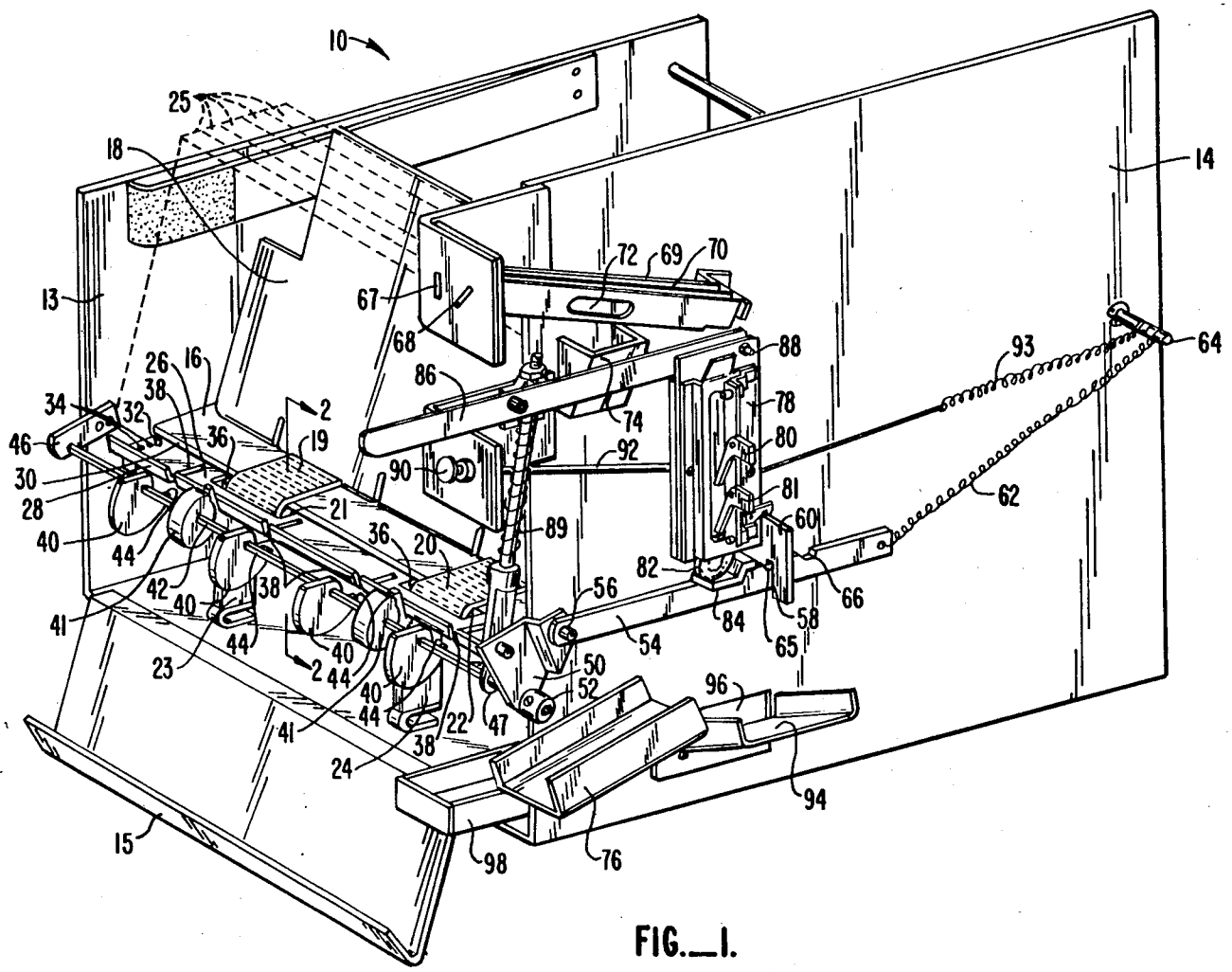
FIG. 1 is a perspective view of the preferred embodiment of the present invention.

The preferred embodiment 10 of the single newspaper dispenser of the present invention is illustrated generally by reference to FIG. 1. Dispenser 10 includes a housing with a bottom 12 and sides 13, 14. A paper drop 15 depends from bottom 12. Bottom 12 and sides 13, 14, together with their appendages as described hereinafter, are designed as an integral module, for insertion in a surrounding enclosure with drop 15 exposed. The module could be inserted into existing newspaper rack of necessary dimensions in a retrofit mode, or could form part of an original equipment package.

A support plate 16 is horizontally mounted between sides 13, 14. A backplate 18 rides along support plate 16, and is biased forwardly by belts 19, 20 which turn idler rollers 21, 22, past brake members 23, 24, and are in turn pulled rearwardly as described in more detail hereinafter. A plurality of newspapers 25 are positioned in a vertical stack supported by belts 19, 20 overlying support plate 16, with backplate holding the newspapers in a generally vertical position (tilted slightly backwardly), with the folded edges down.

A lip member 26 having a raised lip 28 is located at the forward edge 30 of support plate 16. Pins such as 32 which are fixed relative to support plate 16 engage one of a plurality of apertures 34 so that the location of lip member 26 relative to support plate 16 is adjustable. Lip member 26 has a pair of openings 36 in which idler rollers 21, 22 are located.

Lip member 26 has a plurality of parallel slots 38 formed in its front edge. A plurality of corresponding dispensing cam elements 40 and brake cam elements 41 are mounted on a common shaft 42. Each dispensing cam element 40 has a projecting tongue 44 which moves upwardly into an associated slot 38 upon rotation of shaft 42. Brake cam elements 41 control brake members 23, 24 as illustrated hereinafter.

Shaft 42 is rotatably supported by brackets 46, 47. A crank 50 is nonrotatably fixed to shaft 42 by bushing 52 so that the crank rotates with the shaft. A coin bar 54 is pivotably attached to crank 50 at pin 56, and extends rearwardly through a slot 58 in flange 60. A spring 62 interconnecting the aft end of coin bar 54 and a fixed post 64 biases the coin bar upwardly and backwardly. Coin bar 54 has a pair of rectangular recesses 65, 66, and forward recess 65 is typically engaged by flange 60 to prevent rotation of shaft 42 except when the device being correctly operated as described hereinafter.

Exposed coin slots 67, 68 are provided for the insertion of coins, which are transported by a pair of corresponding coin chutes 69, 70. Chutes 69, 70 have a side opening 72 sized so that pennies will fall out of the coin chutes. The falling penny falls through a penny guide 74 and slides down a reject chute 76 into an accessible reject slot (not shown). Coins other than pennies travel down coin chutes 69, 70 and fall into the coin holder 78. Coin holder 78 is a conventional type known in the industry and contains dogs 80, 81 which hold the coins down and prevent their upward movement only if the proper amount of coinage is inserted. In the embodiment shown in FIG. 1, the price of the papers being distributed is 25¢ and a quarter 82 is illustrated in position, held down by dog 81.

A ramp 84 is fixed to the upper surface of coin bar 54, and prior to actuation of the system is located immediately beneath the inserted coin 82 in coin holder 78. A manually actuatable lever 86 is rotatable about a pin 88, which also supports coin holder 78. Lever 86 is attached to crank 50 by an adjustable rod 88 with a circumscribing spring 89. Although lever 86 and coin holder 78 are supported by the same pin connection 88, they are independently rotatable. As lever 86 is depressed, crank 50 will be rotated slightly, and coin bar 54 will move slightly forwardly. Such slight forward movement of coin bar 54 forces it downwardly because of quarter 82 bearing down on ramp 84, and this slight downward movement allows recess 65 to be disengaged from flange 60, allowing coin bar 54 to continue to move forwardly, as described in detail hereinafter. If there is no quarter 82 to bear down on ramp 84, or if the improper coinage has not been inserted and dogs 80, 81 do not hold them down, the pressure of lever 86 will merely force recess 65 against flange 60 and further rotation of crank 50 will be prevented.

An external coin reject button 90 is located at the end of a rod 92 attached to coin holder 78. To retrieve inserted coins, the user pulls reject button 90 to rotate coin holder 78 forwardly. Under normal operation, as will be illustrated in more detail hereinafter, as a paper is dispensed the coin will drop onto a coin box chute 94, through an opening 96 inside 14. A coin box 98, shown partially removed in FIG. 1, is normally located immediately inside slot 96 to collect the inserted coins. Coin holder 78 is maintained in its normal position, biased against flange 60, by spring 93.

The operation of dispenser 10 in dispensing the single paper is illustrated by way of reference to FIGS. 2A–2C and 3A–3C, with reference back to FIG. 1. Before operation of the system to dispense the paper commences, it has the configuration illustrated in FIGS. 2A and 3A. Backplate 18 biases the stack of newspapers 25 forwardly, with the foremost newspaper 25' against the raised lip 28 of lip element 26. As is evident from FIG. 2A, each belt such as 20 is fixed to backplate 18 by a screw 100, and projects forwardly beneath papers 24, turning its associated idler roller such as roller 22. Belts 19, 20 are attached to a common bracket 100, which is in turn connected to a spring 102. Spring 102 turns its associated idler pulley 104 and is fixed to frame bottom 12. As a result, newspapers 25 are biased continuously forwardly, and ride on belts 19, 20 overlying support plate 16. The recessed portion of cam 41 bears against the brake members such as brake member 24 so that the brake member is spaced from the belts such as belts 20 (see FIG. 3A) so that movement of the belt is not inhibited.

After the customer has inserted the appropriate coinage, he depresses lever 86, as illustrated in FIG. 2B. The proper coinage releases coin bar 54, allowing crank 50 to rotate, as illustrated later. The tongue portion 44 of each dispensing cam element engages the forwardmost newspaper 25' and lifts and separates it from the stack, moving the lower, folded edge of the newspaper upwardly and forwardly. As illustrated in FIG. 3B, rotation of shaft 42 causes the extended portion of the brake cams 41 to contact the brake member such as brake member 24, forcing the brake members into contact with the belt such as belt 20 so that the belts are locked in position. This minimizes any forward pressure on the paper stack and facilitates the separation of forwardmost newspaper 25' from the remaining newspapers on the stack.

Figure 2C:
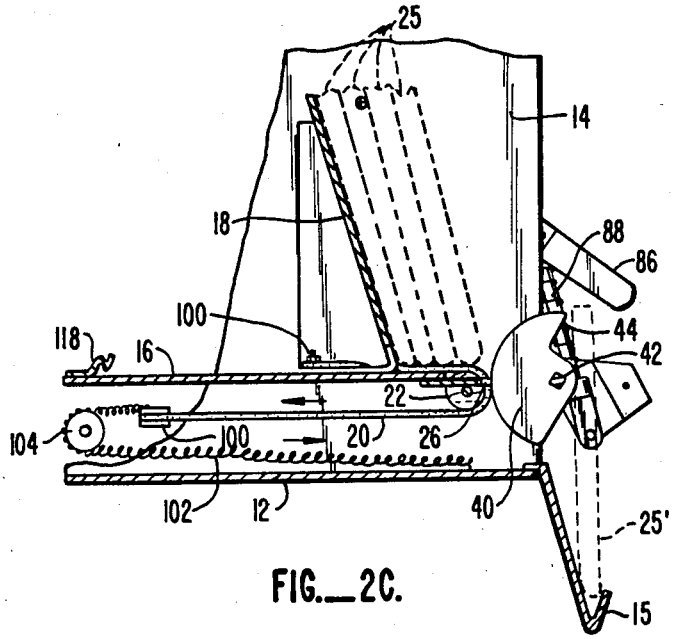
Figure 3C:
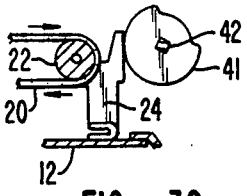

Continued depression of lever 86, as illustrated in FIG. 2C, causes continued rotation of each dispensing cam element 40. Such continued rotation will cause the forwardmost newspaper 25' to ride over cam elements 40 into drop 15, from which it can be retrieved by the consumer. Each cam element 40 has a curved portion 106 contiguous to and following tongue 44. While the forwardmost paper 25' is being dispensed, the curved portion 106 of each cam element 40 blocks the forward movement of the remaining papers 25. After forwardmost newspaper 25' has been dispensed, the spring 89 on rod 88 will cause the mechanism to return to its original configuration, rotating cam elements 40 and 41 back to their original position (FIGS. 2A and 3A), freeing belts 19 and 20 and allowing the next newspaper in the stack to move into contact with raised lip 28.

Figure 4:
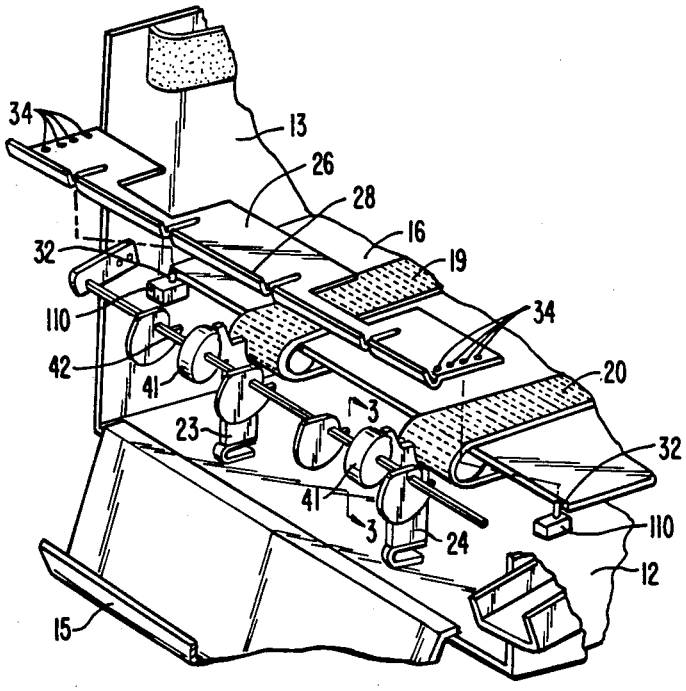
FIG. 4 is a fragmentary exploded view of the lip assembly of the embodiment of FIG. 1.

Proper operation of the system requires that the tongues 44 on the dispensing cam elements 40 fully engage the folded edge of forwardmost newspaper but not any succeeding newspapers. As illustrated in FIG. 4, lip element 26 includes a plurality of apertures 34 on each end. Supports 110 mounted to the frame have upwardly projecting pegs 32 engageable with the recesses 34. Thus, the position of the raised lip 28 on the forward edge of lip element 26 is adjustable relative to support plate 16 and common shaft 42.

Figure 5:
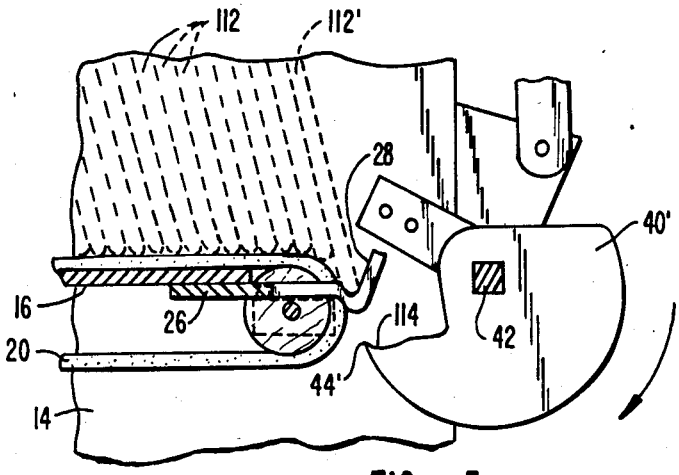
FIG. 5 is a fragmentary elevation view of the embodiment of FIG. 1 employing a modified cam design for use with thin newspapers.

In FIG. 5, adjustment of dispenser 10 to accommodate thin papers 112 is illustrated. While the term "papers" is used herein, and the design is primarily for conventional daily or weekly newspapers, it is to be understood that the term "papers" is used in a generic sense to include flyers, information publications and other types of printed matter which might be dispensed in the fashion indicated. In FIG. 5, lip member 26 has been moved rearwardly relative to the position illustrated in the other figures, placing the forwardmost paper 112' further from the common shaft 42 of dispensing cams 40'. Accordingly, the tongue 44' of each cam element 40' will engage only the forwardmost thin paper 112' when the cam elements are rotated. Cam elements 40' contain a further refinement, to wit a curved indentation 114, which facilitates the separation of relatively thin papers from the remainder of the stack.

Figure 6:
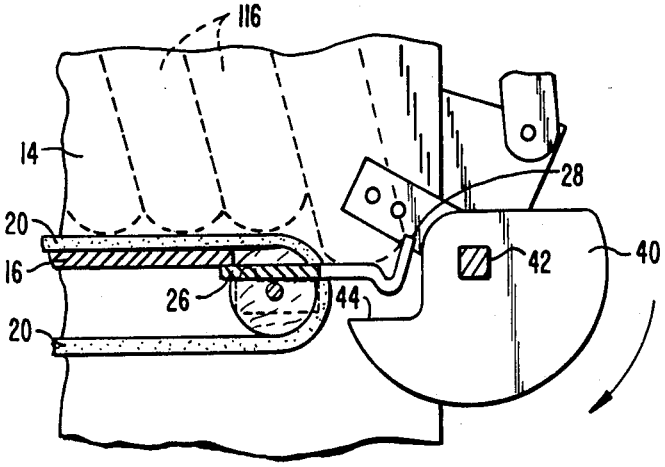
FIG. 6 is a fragmentary section view illustrating the embodiment of FIG. 1 adjusted to dispense thick newspapers.

FIG. 6 illustrates lip element 26 positioned forwardly to accommodate thick newspapers 116. With this adjustment, the tongue 44 of dispensing cam elements 40 will fully engage the folded bottom edge of the forwardmost thick newspaper 116', which is closer to shaft 42 because of the adjustment. It is anticipated that the subject design should be able to accommodate papers ranging from small, weekly newspapers with as few as 8 pages to 720 page major Sunday editions with only the adjustment of the position of the lip element 26, although functioning with small papers is enhanced with the slightly modified cam element 40' illustrated in FIG. 5.

Figure 7:
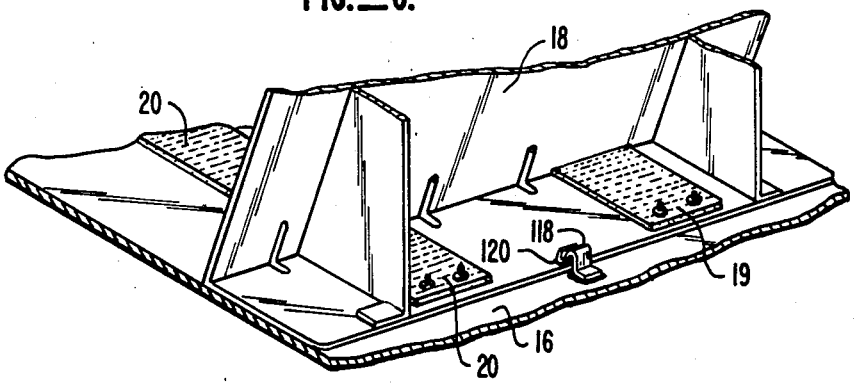
FIG. 7 is a fragmentary perspective view of the backplate of the embodiment of FIG. 1.
Figure 8A:
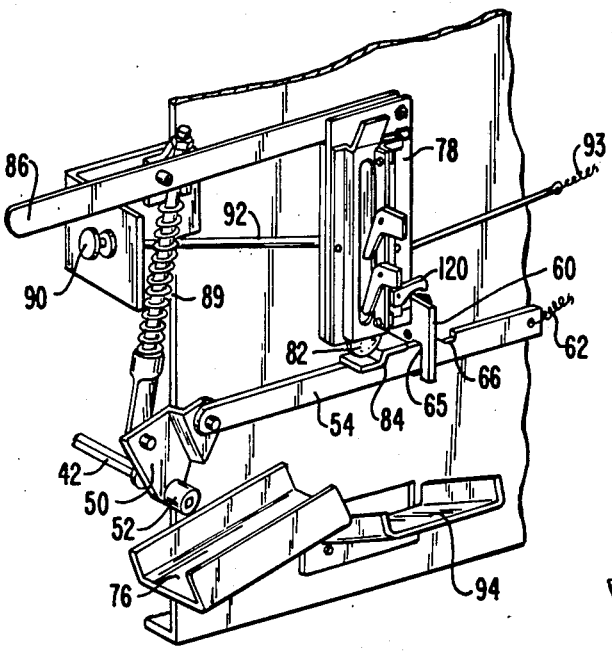
Figure 10A:
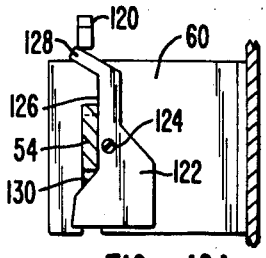
FIGS. 10A and 10B are a sequence of fragmentary elevation views of the coin holder latching mechanism corresponding to FIGS. 8A and B.

To load dispenser 20 with a fresh supply of newspapers, backplate 18 is first pressed backwardly by hand. As illustrated in FIG. 7, a snap member 118 is located at the aft end of support plate 16. The lower portion of backplate 18 has a corresponding recess 120, and when the backplate has been moved fully backwardly snap member 118 engages recess 120, holding the backplate in position. In this configuration, the fresh supply of newspapers can easily be inserted, and backplate 18 moved forwardly to disengage snap member 118 so that the new stack of papers is biased forwardly.

The operation of the coin mechanism as illustrated by way of reference to FIGS. 8A–9D, 9A–9D and 10A–10B. Initially, the system has the configuration of FIG. 8A, which illustrates quarter 82 inserted in coin holder 78. Forward recess 65 is engaged by flange 60 to prevent longitudinal movement of coin bar 54. A latch 120 is pivotably mounted on coin holder 78, and projects rearwardly over flange 60. A release member 122 is pivotably attached to flange 60 by screw 124 (See FIG. 10A). Release member 122 has a flat surface 126 which rests flush against coin bar 54 to hold the release member in the vertical configuration illustrated. Release member 122 has an upper armature 128, and when the release member is maintained in the vertical configuration, armature 128 holds latch 120 in its raised position out of engagement with flange 60.

Figure 9A:
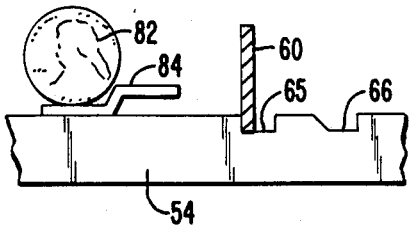
Figure 8B:
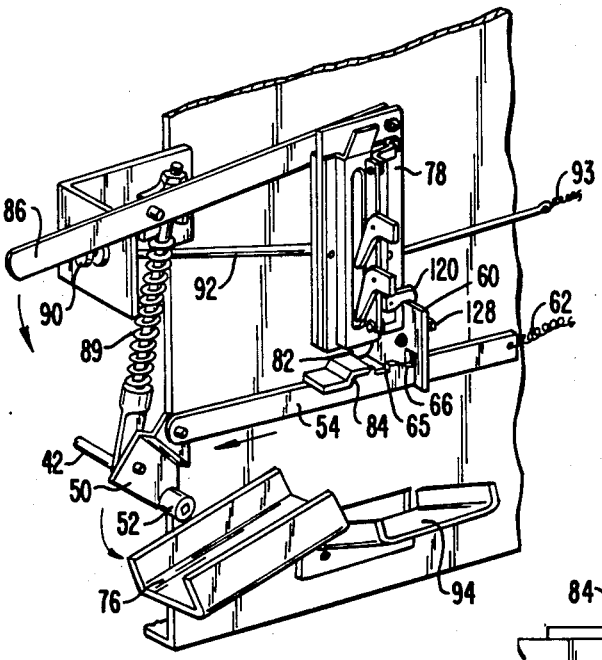
Figure 10B:
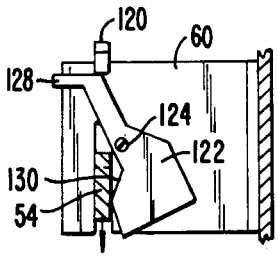
Figure 9B:
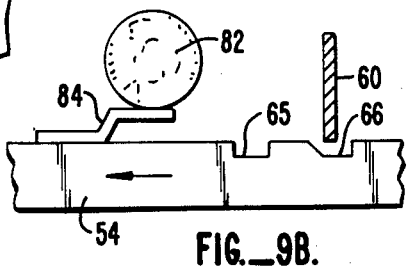
Figure 9C:
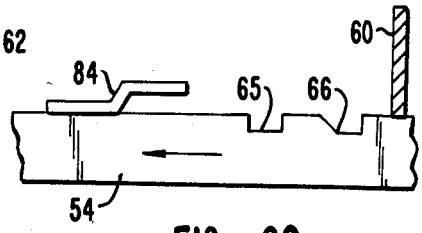

When lever 86 is depressed by the user, as illustrated in FIG. 8B, ramp 84, which is in contact with coin 82, forces coin bar 54 downwardly as it moves forwardly. This movement releases forward recess 65 from flange 60, allowing coin bar 54 to continue to move forwardly. Second recess 66 is also cleared by flange 60 with coin bar 54 depressed by coin 82 on member 84 (FIG. 9B). Downward movement of coin bar 54 moves it against a sidewardly extending portion 130 of release member 122, rotating the release member counterclockwise (FIG. 10B). Armature 128 is moved downwardly and out of engagement with latch 120, which falls into engagement with flange 60. This locks coin holder 78 into position (see FIG. 8B) so that coin return 90 cannot be pulled simultaneous with the depression of lever 86. Without this protective feature, a skilled manipulator might be able to insert the proper coinage, depress the lever sufficiently to release coin bar 54 to obtain the newspaper, while simultaneously actuating coin return button 90 so that the coin is returned rather than collected.

As illustrated in FIG. 7C, with coin holder 78 held in position by latch 120, the user continues to depress lever 86 to dispense the paper. Eventually, ramp 84 moves past the bottom of coin holder 78, allowing coin 82 to fall onto chute 94. Flange 60, which has cleared recesses 65 and 66 on coin bar 54, rides along the top of coin bar until the coin bar reaches the end of its travel, at which point the forwardmost newspaper on the stack will have been dispensed.

Figure 8C:
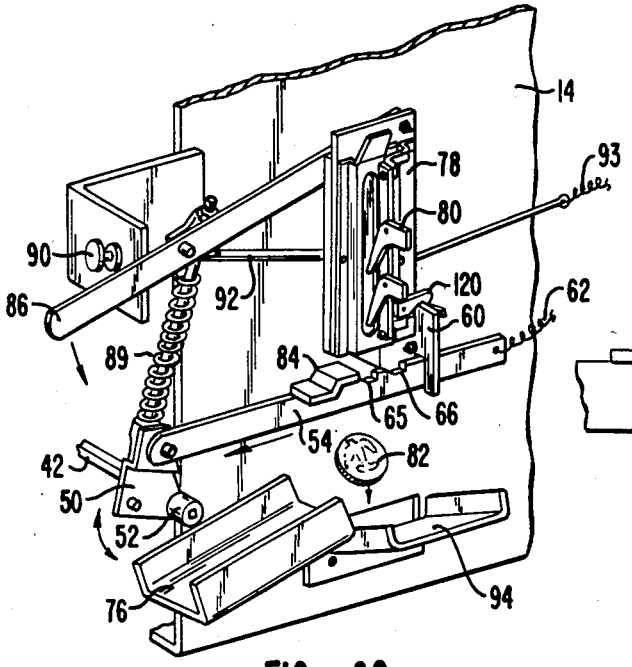
Figure 8D:
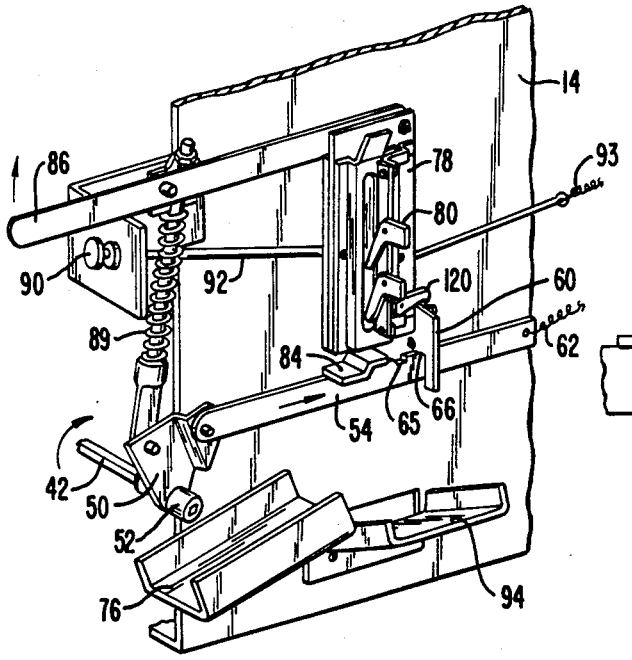
Figure 9D:
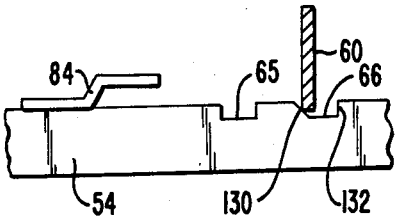

When the user releases lever 86, spring 89 will return the lever and coin bar 54 to their original position. As coin bar 54 returns to its original position, flange 60 will ride along the top of the coin bar, until rear recess 66 is engaged, as illustrated in FIGS. 8D and 9D. Recess 66 has an inclined front face 130, and during normal operation flange 60 will merely slide through the recess until it engages front recess 65 in its rest position. The back face 132 of rear recess 66 is vertical, however, so that coin bar 54 cannot be stopped in an intermediate position and lever 86 depressed again to dispense another paper without the insertion of additional coinage.

Figure 11:
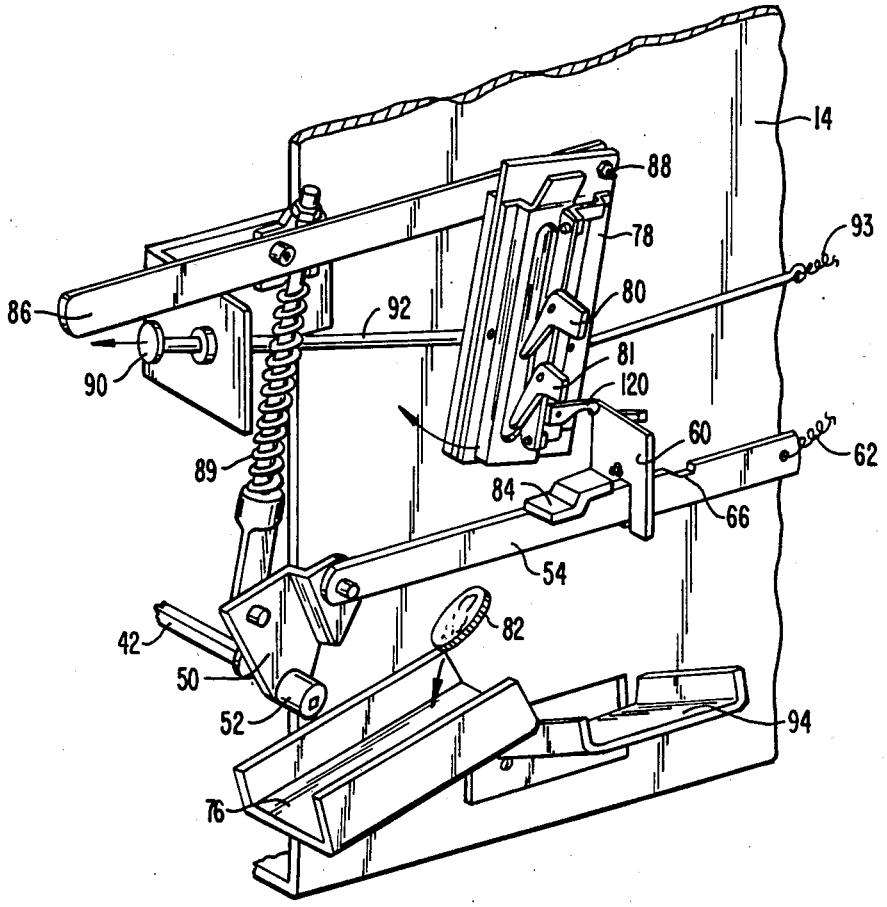
FIG. 11 is a fragmentary perspective view of the coin reject mechanism of the embodiment of FIG. 1.

If coins have been inserted by the consumer changes his mind, or realizes that he has inserted the improper coinage, the coins can be retrieved by actuating the coin return button 90, as illustrated in FIG. 11. The consumer pulls button 90, causing coin holder to rotate forwardly about pin connection 88. When coin 82 clears ramp 84, it will drop down onto coin return chute 76, and be returned to the consumer. Latch 120 will merely move forwardly over the top of flange 60 because it will be held upwardly until it clears the flange by release member 122, as illustrated in FIG. 9A.

While a preferred embodiment of the present invention is illustrated in detail, it is apparent that modifications and adaptations of that embodiment will occur to those skilled in the art. However, it is to be expressly understood that such modifications and adaptations are within the spirit and scope of the invention, as set forth in the following claims.

What is claimed is:

1. A single paper dispenser comprising:

a frame having means for supporting the papers in a generally horizontal stack, said support means having a forward, slotted edge;

flexible belt means extending forwardly along the support means beneath the papers to a position proximate the forward, slotted edge;

means for biasing the stack of papers on the belt means toward said forward, slotted edge of the support means;

cam means rotatable about an axis parallel to the slotted edge, said cam means having tongue means movable upwardly through the slots in said edge and then forwardly relative to the support means upon rotation of the cam means;

means for rotating the cam means to engage the forwardmost paper in the stack with the tongue means, lift and separate the forwardmost paper from the remainder of the stack, and drop said separated paper past the forward edge of the support means;

brake means supported by the frame; and means for biasing the brake means into contact with the flexible belt means while the cam means is rotated to prevent movement of the belt means as the forwardmost paper is being lifted and separated from the remainder of the stack.

2. The dispenser of claim 1 wherein the slotted edge of the support means has a plurality of parallel slots, and wherein the cam means includes a corresponding plurality of cam elements mounted on a common shaft, each cam element having a tongue movable through one of the respective slots.

3. The dispenser of claim 2 wherein each of the cam elements includes a curved portion contiguous to and following the tongue of the cam element, the curved portions of the cam elements holding the remainder of the stack in position while the forwardmost paper is lifted and separated therefrom.

4. The dispenser of claim 1 wherein the support means includes a raised lip at its forward, slotted edge, and wherein said biasing means biases the stack of papers against the lip.

5. The dispenser of claim 4 wherein the position of the lip is adjustable relative to the cam means to accommodate papers of different thicknesses without repositioning the cam means.

6. The dispenser of claim 1 wherein the rotating means includes a coin holder, and unlocking means operable upon insertion of the proper coinage into the coin holder to allow rotation of the cam means.

7. The dispenser of claim 6 wherein the unlocking means includes a coin bar underlying the coin holder, a ramp fixed to the coin bar and adapted to engage a deposited coin in the coin holder, and stop means normally holding the coin bar in position and releasing said coin bar with the coin engaging the ramp.

8. The dispenser of claim 6 and additionally comprising coin return means, and latch means preventing simultaneous operation of the unlocking means and the coin return means.

9. The dispenser of claim 1 wherein the frame includes sides for supporting the stack of papers, resilient armatures extending from the respective sides into contact with the stack, and abrasive means on said armatures for resisting vertical movement of the papers.

10. A single paper dispenser comprising:

a frame having a support plate and sides for supporting the papers in a generally horizontal stack, said support plate having a forward, slotted edge with openings proximate said edge;

a backplate for supporting the papers in a generally vertical configuration;

idler rollers located in the openings in the support plate;

flexible belt means extending from the backplate forwardly along the bottom of the support plate beneath the papers and turning the idler rollers;

spring means attached to the flexible belt means for biasing the backplate forwardly;

means for projecting through the slots to engage the forwardmost paper in the stack, lift and separate the forwardmost paper from the remainder of the stack, and drop the separated paper past the forward edge of the frame bottom;

brake means juxtaposed to the flexible belt means at the position of the idler rollers; and means for forcing the brake means against the belt means while the forwardmost paper in the stack is being lifted and separated from the remainder of the stack.

11. The dispenser of claim 10 wherein the engaging means comprises cam means rotatable about an axis parallel to the slotted edge having tongue means movable upwardly through the slots in the edge and then forwardly relative to the support plate upon rotation of the cam means, and means for rotating the cam means.

12. The dispenser of claim 11 wherein the slotted edge of the support plate has a plurality of parallel slots, and where the cam means includes a corresponding plurality of cam elements mounted on a common shaft, each cam element having a tongue movable through a respective slot.

13. The dispenser of claim 12 wherein each of the cam elements includes a curved portion contiguous to and following the tongue of the cam element, the curved portions of the cam elements holding the remainder of the stack in position while the forwardmost paper is lifted and separated therefrom.

14. The dispenser of claim 10 wherein the support plate includes a raised lip at its forward slotted edge, and wherein the said biasing means biases the stack of papers against the lip.

15. The dispenser of claim 14 wherein the position of the lip is adjustable relative to the cam means to accommodate papers of different thicknesses without repositioning the cam means.

16. A coin-operated single paper dispenser comprising:

a frame having a pair of sides, a support plate between the sides for supporting the papers in a generally horizontal stack, a lip member with a raised lip at a forward edge of the support frame, means for adjusting the position of the lip member relative to the remainder of the frame, resilient armatures extending from the respective sides into contact with the stack, and abrasive means on said armatures for resisting vertical movement of the papers;

a backplate slideable along the support plate for maintaining the newspapers in a nearly vertical configuration;

belt means extending forwardly from the backplate over the support plate beneath the papers;

spring means urging the belt means forwardly to pass the stack of papers against the raised lip;

cam means including a plurality of discrete cam elements located on a common shaft parallel to and spaced from the forward edge of the support plate, each said cam element having a tongue movable upwardly through the associated slot in the opening and then forwardly relative to the frame bottom;

brake means proximate the belt means;

means located on said common shaft for urging the brake means into contact with the belt means to prevent movement of the belt means while the common shaft is being rotated;

a manually actuable lever coupled to the common shaft for rotating the common shaft;

a coin holder for receiving the necessary coinage; and means for allowing rotation of the common shaft when the proper coinage has been inserted in the coin holder, whereupon the tongues of the cam elements engage the forwardmost paper in the stack with the tongues, lift and separate the forwardmost paper from the remainder of the stack, and drop the separated paper past the forward edge of the frame bottom, papers of different thicknesses being accommodated by adjusting the position of the lever without respositioning the cam means.

17. The dispenser of claim 16 wherein the allowing means includes a coin bar underlying the coin holder and attached to the rotating means to prevent rotation of the common shaft on the corresponding translation of the coin bar, a ramp fixed to the coin bar and adapted to engage a deposited coin in the coin holder, and stop means normally holding the coin bar in position releasing said coin bar when the appropriate coinage is located in the coin holder and engaged by the ramp.

18. The dispenser of claim 16 wherein the coin bar has a recess, and wherein the stop means comprises a flange normally engaging the recess and disengaging the recess with the appropriate coinage in the coin holder and engaging the ramp.

19. The dispenser of claim 16 wherein the coin bar has a pair of longitudinally spaced recesses to prevent dispensing of multiple papers upon insertion of the coinage for a single paper.

20. The dispenser of claim 16 and additionally comprising coin return means, and latch means preventing simultaneous operation of the lever and the coin return means.

21. The dispenser of claim 16 wherein each of the cam elements has a curved portion contiguous to and following the tongue of the cam element, the curved portions of the cam elements holding the remainder of the stack in position while the forwardmost paper is lifted and separated therefrom.

* * * * *